United States Patent [19]

Curtaz et al.

[11] Patent Number: 4,777,945

[45] Date of Patent: Oct. 18, 1988

[54] PUNCTUAL MASSAGER USING VERTICAL AND ROTARY MOVEMENTS OF MASSAGE PIN

[75] Inventors: Werner Curtaz, Freisenheim; Bernhard Sacherer, Kürzell, both of Fed. Rep. of Germany

[73] Assignee: Tukan Anstalt, Liechtenstein

[21] Appl. No.: 899,298

[22] PCT Filed: Nov. 13, 1985

[86] PCT No.: PCT/CH85/00162

§ 371 Date: Jul. 28, 1986

§ 102(e) Date: Jul. 28, 1986

[87] PCT Pub. No.: WO86/03119

PCT Pub. Date: Jun. 5, 1986

[30] Foreign Application Priority Data

Nov. 29, 1984 [DE] Fed. Rep. of Germany ..... 3443358

[51] Int. Cl.[4] ..... A61H 7/00; A61H 23/02

[52] U.S. Cl. ..... 128/52; 128/49; 128/55; 128/60

[58] Field of Search ..... 128/48–50, 128/51–53, 55, 59, 60, 61

[56] References Cited

U.S. PATENT DOCUMENTS

| | | | |
|---|---|---|---|
| 1,237,570 | 8/1917 | Stevenson | 128/48 |
| 1,577,751 | 3/1926 | Paschall | 128/48 |
| 2,036,677 | 4/1936 | Bergman | 128/48 |
| 2,041,693 | 5/1936 | Boltz et al. | 128/49 |
| 2,413,133 | 12/1946 | Aydelotte | 128/48 |
| 2,534,412 | 12/1950 | Barnett et al. | 128/49 |
| 3,035,570 | 5/1962 | Nelson | 128/49 |
| 3,083,709 | 4/1963 | Longsfeld | 128/52 |
| 3,626,933 | 12/1971 | Pollock et al. | 128/52 |
| 3,664,331 | 5/1972 | Filipovici | 128/51 |
| 3,906,940 | 9/1975 | Kawada | 128/49 |
| 3,939,825 | 2/1976 | Krummenacher | 128/52 |
| 4,009,710 | 3/1977 | Inada | 128/44 |

FOREIGN PATENT DOCUMENTS

| | | | |
|---|---|---|---|
| 7441025 | 4/1975 | Fed. Rep. of Germany . | |
| 3326801 | 2/1985 | Fed. Rep. of Germany | 128/48 |
| 7618557 | 6/1976 | France | 128/51 |
| 459783 | 2/1937 | United Kingdom . | |

*Primary Examiner*—David Wiecking
*Assistant Examiner*—Tonya Lamb
*Attorney, Agent, or Firm*—Seed and Berry

[57] ABSTRACT

Massage appliance for the punctual massage of individual regions of the human body, especially of the reflex zones of the soles of the feet, having a massage pin (10) which can be set vibrating (stroke movements) and is simultaneously displaceable along a closed, preferably circular path (rotary movement), the direction of vibration (stroke direction) corresponding substantially to the axial direction of the massage pin (10). The massage pin (10) is connected to a vibratory body (24) which is engaged by a crank (25) drivable by a electric motor (19) via a reduction gear (21, 23). Associated with the vibratory body (24) is a vibration apparatus (stroke apparatus) consisting of a guide lever (26) which is secured beneath the vibratory body (24) to an axially slidable rod (27). The housing (4) has an opening (7) in which a cap (8), having a central passage-hole (9) for the mounting pin (10) and an edge (29) as security against falling out, as well as an operating member for the switch (30) of the electric motor, is disposed.

30 Claims, 3 Drawing Sheets

PUNCTUAL MASSAGER USING VERTICAL AND ROTARY MOVEMENTS OF MASSAGE PIN

DESCRIPTION

1. Technical Field

The invention relates to a massage appliance for the punctual massage of individual regions of the human body, especially of the soles of the feet, having a massage pin and an apparatus bearing the latter.

2. Background of the Invention

Associated with the individual parts and organs of the human body are reflex zones which are distributed over the whole body. Most of these reflex zones, however, are situated in the region of the feet, especially of the soles of the feet. It has long been known that by means of the punctual massage of these reflex zones, it is possible to produce impulses which run via the nerves and the brain from the massaged reflex zone to the appurtenant part or organ of the body, whereby the blood circulation and the functioning capability of this part or organ of the body and of the glands is stimulated, and in addition toxic and waste matter deposited in the region of the respective reflex zone is dissolved and removed from the body via the blood-streams and excretory organs.

Yet, to be sure, optimum results can as a general rule be achieved only by an experienced therapist who recognizes the cause of his patient's complaints and knows which of the numerous reflex zones is to be punctually massaged for eliminating the respective complaint.

DISCLOSURE OF THE INVENTION

The massage appliances known heretofore are at best suitable for stimulating the user's blood circulation generally but not for effectively treating individual reflex zones punctually. This also applies, for example, to the massage appliance known from the DE-UM No. 7,441,025, which has a massage pin borne by a supporting surface, for with this appliance both the massage pressure and the massage movements must be mustered by the user himself, which leads to cramping of the user's mostly untrained muscular system and, if only for that reason, jeopardizes the desired massage result.

The problem underlying the invention is to provide a massage appliance of the kind described at the beginning, which makes possible reflex-zone massages, and with which it is possible also for the unpracticed layman to continue, e.g., at home, a reflex-zone massage begun by an experienced therapist.

According to the invention, this problem is solved by a masssage appliance of the kind described at the beginning, in which there is associated with the massage pin a drive by which the tip of the massage pin can be set vibrating and can be displaced along a closed, preferably circular path. "Vibration" of the tip of the massage pin being understood to mean its up-and-down movement, and the direction of vibration of the tip of the massage pin corresponding substantially to the axial direction of the massage pin.

A massage appliance thus formed makes it possible for even the unpracticed user to simulate the manual activity of the therapist without having to put up with the cramping of individual parts of the body which often makes a successful reflex-zone massage impossible.

Because of its unproblematical and convenient manipulation, a massage appliance thus formed is especially suited in addition for a permanent precautionary treatment which creates a balanced, harmonious body household or important prerequisites therefor.

The drive of the massage pin may, in the massage appliance according to the invention, have a preferably eccentrically drivable vibratory body to which the massage pin is preferably detachably connected. A crank may advantageously engage this vibratory body. This crank may be drivable via an electric motor, preferably via an interposed reduction gear, the speed of rotation of the electric motor preferably being infinitely variable and capable of modulation. The latter offers the advantage that the massage effect of the tip of the massage pin can be adapted to the particular requirements.

There may be associated with the aforementioned vibratory body, which, together with the massage pin borne thereby, is displaceable in a plane by means of the crank engaging it, a vibration apparatus by means of which it is possible to set the vibratory body and the massage pin borne by it vibrating, i.e., to move them up and down, and to move the vibratory body and the massage pin to and fro in a circular path.

In a preferred embodiment, the aforementioned vibration apparatus has at least one guide lever which is pivoted in the region of one of its ends on the vibratory body and is preferably secured in the region of its other end to an axially slidable rod running beneath the vibratory body and/or behind the vibratory body.

In an alternative embodiment, the aforesaid guide lever may have in the region of its end distant from the vibratory body a friction bearing in which a stationary guide rod running beneath the vibratory body and/or behind the vibratory body is guided.

For the electric motor, via which the aforementioned crank is drivable, a switch can be provided, and for the latter a preferably spring-biased operating device in the region of the massage pin, it also being possible, if so desired, to form and dispose the operating device in such a way that it can be operated by the part of the body to be treated itself, thus, for example, by a foot of the user of the appliance.

The drive associated with the massage pin and, as the case may be, including the drive motor thereof, may be disposed in a housing, made preferably of plastic, which has an opening through which the upper region of the massage pin projects. There may be disposed with play in this housing opening a cap which has a central passage-hole for the upper region of the massage pin and is secured against falling out or being pressed out of the housing. For securing the cap against falling out or being pressed out of the housing, the cap may have an edge protruding inwardly in the housing or at least one projection provided on its circumference.

In a preferred embodiment, aforesaid cap forms the operating member for the switch of the electric motor of the massage-pin drive, with the result that by pressing in the cap, the electric motor of the massage-pin drive is automatically switched on. The length of the massage pin may be so determined that, when the appliance is switched off, its upper region protrudes from the cap surrounding it, so that before the electric motor is switched on, it is possible to work first with a massage pin which is unmoved, thus set neither vibrating nor rotating.

The speed of rotation of the electric motor of the massage-pin drive is preferably infinitely variable by means of the latter's switch, so that it can be unproblematically adapted to the particular requirements.

In a preferred embodiment, the housing of the massage appliance according to the invention has, for at least one foot, a substantially rectangular foot-rest surface which is formed grippingly, e.g. with nubs, and in which the aforementioned opening for the massage pin or for the cap surrounding the latter is provided. When the appliance is disposed on a horizontal surface, the foot-rest surface may be slightly inclined thereto, whereby the resting of the foot is facilitated. This angle of inclination may, if desired, be variable, e.g., in that the housing has a bottom hinged-on on one side and telescopic supports cooperating therewith.

The massage pin of the massage appliance according to the invention may be formed hollow and is preferably made of plastic. However, it may also be made of wood, metal, or rubber. In the massage appliance according to the invention, the massage pin is preferably interchangeable, for which purpose the vibratory body bearing it may have a receptacle in which the massage pin is insertable. In order to ensure an effective hold for the massage pin, aforesaid receptacle may be formed slightly conical.

In the preferred embodiment of the massage appliance according to the invention, the massage pin includes a preferably interchangeable pin cap which is preferably made of plastic but may also be made of wood, metal, or rubber, if necessary.

The massage pin or, as the case may be, its pin cap may be provided with nubs, whereby the massage effect of the tip portion of the massage pin, or in the preferred embodiment the pin cap of the massage pin, can be increased.

The vibration frequency of the massage pin may, in the massage appliance according to the invention, be between 50 and 80 vibrations/min., it is preferably 60 vibrations/min., while the vibration stroke of the massage pin equals 2 to 5, preferably 3 mm, and the orbital frequency of the tip of the massage pin is between 50 and 80, preferably 60 orbits/min.

Further details, features, and advantages of the invention follow from the claims and the following description of a preferred embodiment of the massage appliance according to the invention in connection with the drawings.

BRIEF DESCRIPTION OF THE DRAWINGS

In the drawings, in each case schematically.

BEST MODE FOR CARRYING OUT THE INVENTION

Figure 1:
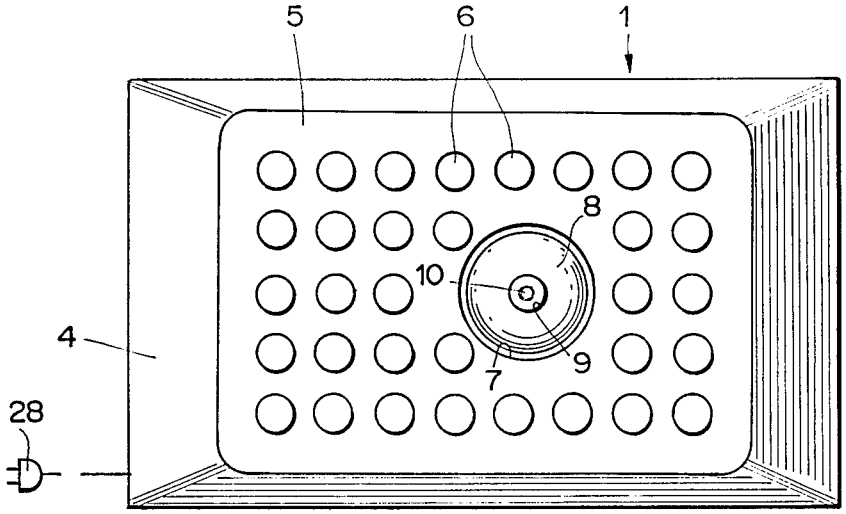
FIG. 1 shows a top plan view of a massage appliance according to the invention formed as a standing model.

The massage appliance 1 depicted in FIGS. 1 to 4 is intended to be put down on the floor or some other horizontal surface for use. It has a rectangular bottom plate 2, distributed along the edge portions of which are through-holes 3 for screws, by means of which the bottom plate 2 can be screwed to a hood 4 covering it. The hood 4 has for this purpose correspondingly disposed inner stops which, when the hood 4 is put on, rest on the edge of the bottom plate 2.

The hood 4 and the bottom plate 2 form the housing of the massage appliance 1 and are each made of a easy-to-care-for and impact-insensitive plastic.

The hood 4 is, in plan, adapted to the shape of the bottom plate 2 and has on its top side a foot-rest surface 5, one of the short sides of which, depicted in each case at the right in the drawings, is at a somewhat greater distance from the bottom plate 2 than its other short side, i.e., the foot-rest surface 5 runs slightly inclined to the bottom plate 2. The top surface of the foot-rest surface 5 is fashioned grippingly by use of nubs 6 and so dimensioned that it can serve as a rest for at least one human foot. Instead of the nubs 6, the gripping capacity of the foot-rest surface 5 may also be achieved by means of a slight profiling.

In the higher region of the foot-rest surface 5, there is provided in the middle an opening 7 through which a substantially hat-shaped cap 8 projects; this cap 8, preferably likewise made of an easy-to-care-for and impact-insensitive plastic, has in turn a central passage-hole 9 for the upper region of a massage pin 10.

Secured to the bottom plate 2 under the hood 4 is a frame 11 which consists of several frame parts 12 to 18 running, in plan, parallel to the sides of the bottom plate 2. The frame parts 12 to 18 are rigidly interconnected and preferably each made of plastic.

Numbered among the frame parts 12 to 18 are, first, two plate-shaped frame parts 12, 13 running parallel to the short sides of the bottom plate 2 and secured to the bottom plate 2, of which the plate-shaped frame part 12 depicted at the left in the drawings is shorter than the second plate-shaped frame part 13 opposite it. From the top edge of the shorter plate-shaped frame part 12, rails 14, 15 secured laterally thereto lead to the taller plate-shaped frame part 13. These rails 14, 15 run parallel to the bottom plate 2 and are secured to the two plate-shaped frame parts 12, 13. Secured between the two rails 14, 15 is a further plate-shaped frame part 16 which, however, reaches only to their bottom edge, the top edge of which, however, is at the same distance from the bottom plate 2 as the upper edge of the plate-shaped frame part 13 depicted in each case at the right. The three plate-shaped frame parts 12, 13, and 16 each run parallel to one another and in each case at right angles to the bottom plate 2 and to the rails 14, 15 connecting them. The upper edges of the two plate-shaped frame parts 13, 16 are connected to one another by rails 17, 18 running parallel to the bottom plate 2 and parallel to the longer rails 14, 15 running under them. Secured between the upper rails 17, 18 and the lower rails 14, 15 is an electric motor 19, the drive shaft 20 of which projects downward. Provided in the bottom plate 2 for the free end of the drive shaft 20 is a recess serving as an abutment.

The middle plate-shaped frame part 16 starting from the lower edges of the two longer rails 14, 15 and reaching to the upper edges of the two shorter rails 17, 18 has a vertical opening for a shaft 21, for the bottom end of which a recess serving as bearing is provided in the bottom plate 2. Secured to this shaft in the region beneath the two longer rails 14, 15 and above the bottom plate 2 is a circular disk 22 which serves as a reduction gear and is provided at the circumference with a friction covering 23 and is so dimensioned that it is operatively connected to the drive shaft 20 of the electric motor 19, i.e., is set rotating as soon as the electric motor 19 is started up.

The region of the shaft 21 projecting out of the plate-shaped frame part 16 at the top is formed crank-shaped. The free crank end 25 is operatively connected to a vibrating body 24, for which purpose the latter is provided with a vertically running opening.

Figure 3:
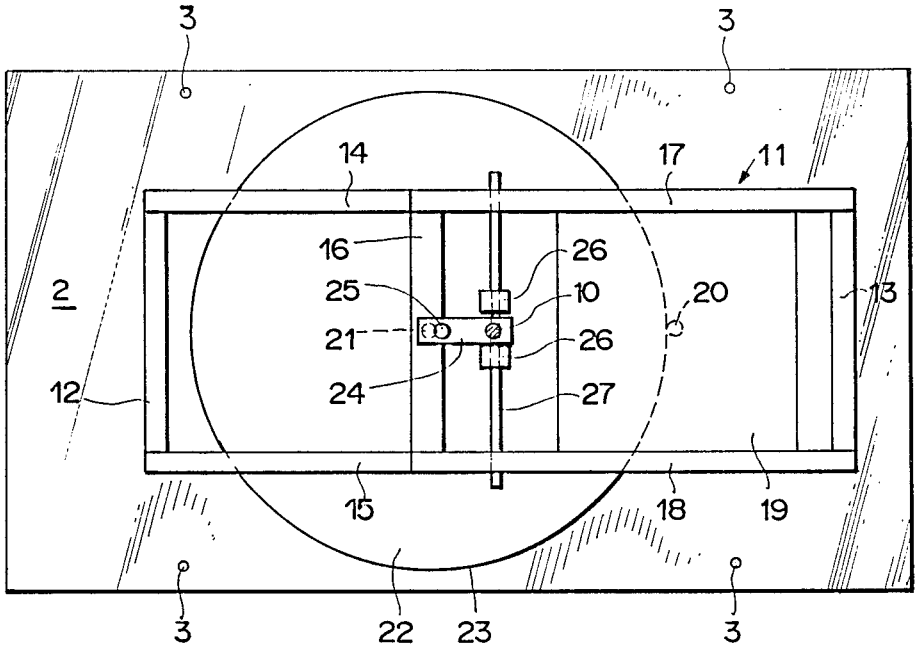
FIG. 3 shows a top plan view of the massage appliance depicted in FIGS. 1 and 2 without hood.
Figure 4:
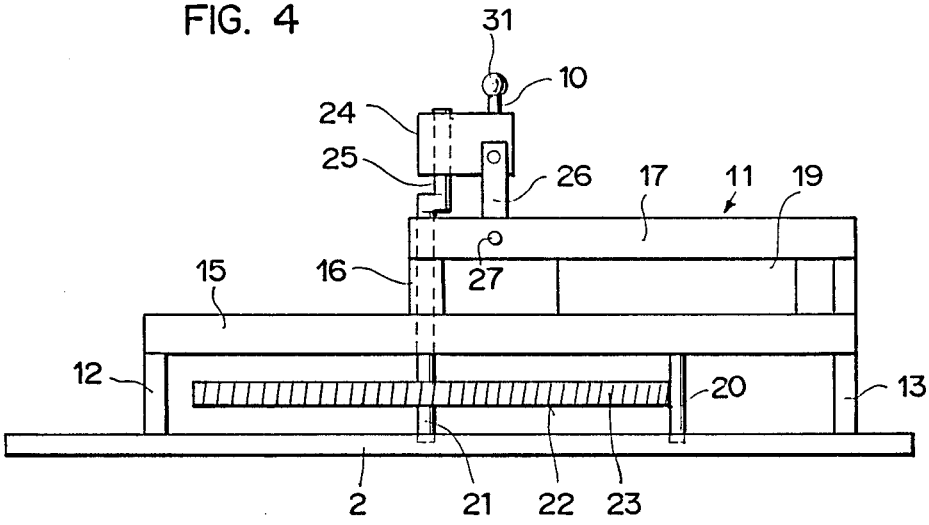
FIG. 4 shows a side elevation of the massage appliance depicted in FIGS. 1 and 2 without hood.

The vibratory body 24 has substantially the shape of a plate-shaped rectangular parallelepiped, the longitudinal edges of which run, in the position depicted in FIGS. 3 and 4, parallel to the longitudinal edges of the bottom plate 2. Provided in the region of this rectangular parallelepiped pointing to the left in each of FIGS. 3 and 4 is the aforementioned vertical opening for the free crank end 25 of the shaft 21, while the region pointing to the right in each of FIGS. 3 and 4 bears the previously mentioned massage pin 10. The massage pin 10 is connected to the vibratory body 24, preferably interchangeably, preferably by use of a slightly conical receptacle in the vibratory body 24 into which the pin is insertable. Beneath the massage pin 10, a guide lever 26 is pivoted on each of the two sides of the vibratory body 24. The ends of the two equally long guide levers 26 distant from the vibratory body 24 are secured to a rod 27 running beneath the vibratory body 24, for which rod friction bearings are provided in the two upper and shorter rails 17, 18.

Figure 2:
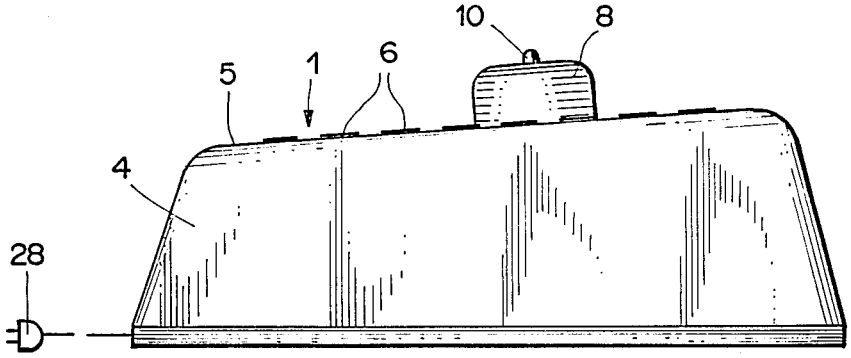
FIG. 2 shows a side elevation of the massage appliance depicted in FIG. 1.

If the electric motor 19, for the power supply of which a feed line 28 only schematically indicated in FIGS. 1 and 2 is provided, is switched on, the result of this is that the shaft 21, operatively connected via its friction covering 23 to the drive shaft 20 of the electric motor 19, is set rotating, and in the same way its crank-shaped end 25. Since the crank-shaped end 25 of the shaft 21 is operatively connected to the vibratory body 24, the vibratory body 24 is likewise displaced, and this in such a way that the tip of the massage pin 10 borne by it carries out a circular, in plan, movement. In addition, the tip of the massage pin 10 rises and falls.

The latter is to be attributed to the two guide levers 26 pivoted on the vibratory body 24 and secured to the axially slidable rod 27. These bring about in addition that the tip of the massage pin 10, in plan, is displaced on a closed orbit, the center of which lies neither on the axis of the shaft 21 nor on the axis of the crank-shaped region 25 of the shaft 21, but rather on an axis which runs perpendicular to the longitudinal axis of the rod 27.

Figure 5:
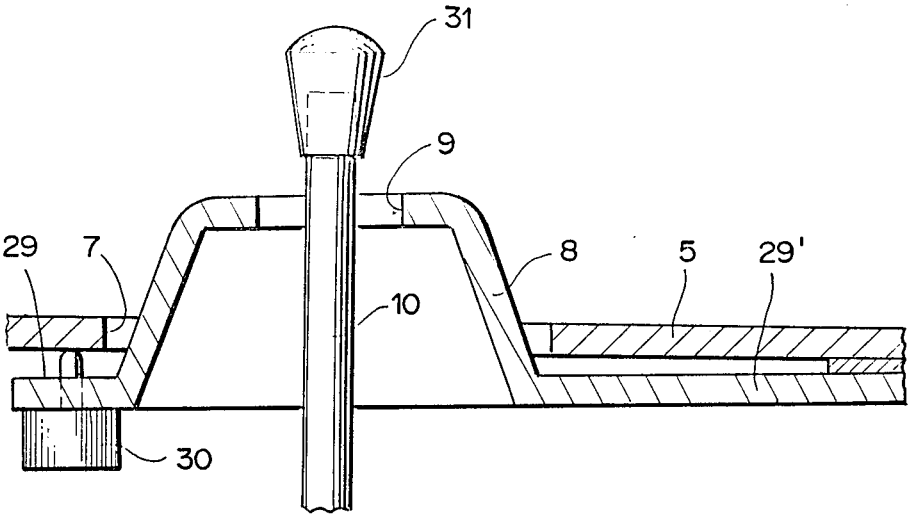
FIG. 5 shows a partially sectional partial view of the massage appliance depicted in FIGS. 1 to 4 on a larger scale.

As already mentioned, the cap 8 surrounding the upper region of the massage pin 10 is formed substantially hat-shaped, its edge 29 preventing its being able to be pressed out of the hood 4 from inside. Its edge 29 is wider on one side, depicted at the right in FIG. 5, and there in the outer edge region 29' is secured on the inside to the hood 4. Since the cap 8 and its edge 29, 29' are made of a spring-elastic plastic, the result of this cap-fastening is that the cap 8 can be pressed into the interior of the housing from outside by light pressure, e.g., exerted by a foot of the user of the massage appliance, and automatically returns to its starting position when no more pressure is exerted on it from outside. There may be disposed between the edge 29 of the cap 8 and the inside of the hood 4 a sensitive switch 30 (cf. FIG. 5) which responds and supplies current to the electric motor 19 as soon as the cap 8 is pressed in even slightly. Through the return movement of the cap 8 into its starting position, an automatic power supply to the electric motor 19 is then interruptible by means of this switch 30. The electric motor 19 and its switch 30 are situated in a circuit powered by the feed line 28, the connection wires of which circuit are not depicted in the drawing for reasons of better clarity.

Figures 6A, 6B, 6C, 6D:
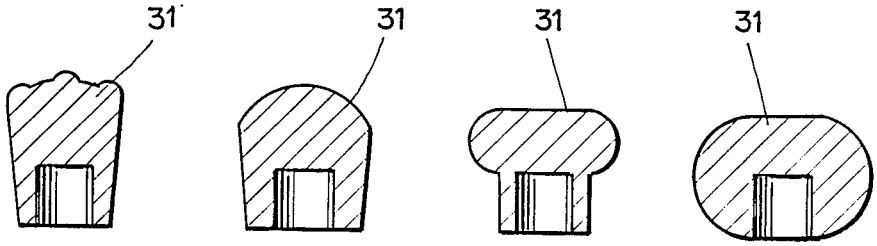
FIG. 6 shows four sectional side views of pin caps for the massage pin of the massage appliance depicted in FIGS. 1 to 4.

The massage pin 10 borne by the vibratory body 24 and connected thereto, preferably detachably, may be formed solid, but also hollow if so desired. The end of it pointing upward may be used directly for reflex-zone massage, but may also be provided with a pin cap 31 if so desired. Various shapes of such massage pin caps are depicted in the drawings of FIG. 6.

For using the massage appliance 1 previously described, it is to be placed preferably on a soft foundation, e.g., a rug, in such a way that it is within reach of the seated user with the sole of his foot from a comfortable sitting position. The appliance should then be connected to the mains by means of the feed line 28. The user can now, in a relaxed seated posture, place one foot on the massage appliance 1. As soon as his foot touches the cap 8, the massage pin 10 begins to carry out massage movements, the intensity (force) of which is dependent upon the pressure exerted on the cap 8, so that it can be infinitely variably adjusted individually by the user. The contact surface between the massage pin 10 or its pin cap 31 and the sole of the foot is relatively small, with the advantage that with precision, individual parts of the foot, the sole of the foot, the inside of the foot, the outside of the foot, or the toes can be reached and massaged with the intensity desired in each case.

If the contact between the foot and the cap 8 of the massage appliance 1 is interrupted, the massage appliance 1 is automatically switched off without a separate switch having to be operated for this purpose. For switching on the appliance 1, it then suffices again to press in its cap 8 more or less forcefully. The massage appliance 1 according to the invention thus offers the additional advantage that it is ready for use at any time without great preparations even if there should be only little time available for the daily massage.

We claim:

1. A massage appliance for the punctual massage of individual regions of the human body, especially of the soles of the feet, having a massage pin having a tip, and having a drive means attached to said pin for moving said pin in a closed path and having a vibrating means attached to said pin for simultaneously moving said pin in a direction of vibration corresponding substantially to the axial direction of the pin; said drive means including an eccentrically drivable vibratory body with which the massage pin is connected; said vibrating means including at least one guide lever having a top end and a bottom end, said top end being pivoted on the vibratory body.

2. Massage appliance for the punctual massage of individual regions of the human body, especially of the soles of the feet, having a massage pin with a tip, characterized in that associated with said massage pin (10) is drive means operatively connected to said massage pin for simultaneously moving said massage pin (10) in a closed path and in a direction of vibration corresponding substantially to the axial direction of said massage pin (10), said drive means including a crank (25) engaging a vibratory body (24) by which said massage pin is carried to move said vibratory body in said closed path upon rotation of said crank, and further including rotary means for rotating said crank, said drive means further including at least one guide lever having first and second end portions with said first end portion pivotally attached to said vibratory body and said second end portion pivotally attached to a frame of the appliance in a manner to cause said vibratory body to move in said substantially axial direction of vibration as said crank moves said vibratory body in said closed path.

3. Massage appliance for the punctual massage of individual regions of the human body, especially of the soles of the feet, having a massage pin with a tip, characterized in that associated with said massage pin (10) is drive means operatively connected to said massage pin for simultaneously moving said massage pin (10) in a closed path and in a direction of vibration corresponding substantially to the axial direction of said massage pin (10), said drive means including a drive motor (19) to provide drive energy to said massage pin, said drive motor being disposed in a housing which has an opening (7) through which an upper portion of the massage pin (10) projects, said drive means further including a cap loosely disposed in said opening (7), said cap (8) having a central passage-hole (9), said massage pin upper portion projecting through said passage-hole, and said cap being secured in said opening against falling out or being pressed out of the housing.

4. Massage appliance according to claim 3 wherein said cap has nubs.

5. Massage appliance according to claim 3, characterized in that the cap (8) is secured against falling out or being pressed out of the housing by at least one projection (29, 29') provided on its circumference.

6. Massage appliance according to claim 5 wherein said projection includes a protruding edge of said cap.

7. Massage appliance for the punctual massage of individual regions of the human body, especially of the soles of the feet, having a massage pin with a tip, characterized in that associated with said massage pin (10) is drive means operatively connected to said massage pin for simultaneously moving said massage pin (10) in a closed path and in a direction of vibration corresponding substantially to the axial direction of said massage pin (10), said drive means including a drive motor (19) to provide drive energy to said massage pin, said drive motor being disposed in a housing which has an opening (7) through which an upper portion of the massage pin (10) projects, said drive means further including a switch for controlling operation of said drive motor, and said housing includes a cap (8) movably positioned in said opening and operatively engaging said switch (3), said cap being movable by pressure applied thereto by the foot of the person receiving the massage to operate said switch.

8. Massage appliance according to claim 7, characterized in that said massage pin upper portion projects through a central passage-hole in said cap and when the appliance is switched off, said massage pin (10) upper portion protrudes from the cap (8) surrounding it.

9. Massage appliance according to claim 7, characterized in that the speed of rotation of said drive motor (19) is regulated by selective operation of said switch (30).

10. Massage appliance according to claim 7, characterized in that the housing has, for at least one foot, a substantially rectangular foot-rest surface (5) with a non-skid surface, said opening being formed in said foot-rest surface.

11. Massage appliance according to claim 10, characterized in that when the appliance (1) is disposed on a horizontal surface, the foot-rest surface (5) has an inclined angular orientation relative thereto.

12. Massage appliance according to claim 11, characterized in that the angular orientation of said foot-rest surface (5) is adjustably variable.

13. Massage appliance for the punctual massage of individual regions of the human body, especially of the soles of the feet, having a massage pin with a tip, characterized in that said massage pin is carried by a vibratory body (24), and associated with said massage pin (10) is drive means operatively connected to said massage pin for simultaneously moving said massage pin (10) in a closed path and in a direction of vibration corresponding substantially to the axial direction of said massage pin (10), said drive means providing eccentric drive to said vibratory body and having at least one guide lever (26) with first and second end portions, said first end portion being pivotally attached to said vibratory body.

14. Massage appliance according to claim 13, characterized in that said drive means reciprocally moves said massage pin in said direction of vibration with a stroke having a length equaling 2 to 5 mm.

15. Massage appliance according to claim 13 wherein said closed path has a circular shape.

16. Massage appliance according to claim 13, characterized in that said drive means moves said massage pin one complete trip about said closed path between 50 and 80 times each minute.

17. Massage appliance according to claim 13, characterized in that said drive means reciprocally moves said massage pin in said direction of vibration at a frequency between 50 and 80 cycles/minute.

18. Massage appliance according to claim 13, characterized in that the massage pin (10) is formed hollow.

19. Massage appliance according to claim 13, characterized in that said drive means includes an electric motor (19) to provide drive energy to move said massage pin, and a switch (30), said switch being operatively spring-biased and located in the region of the massage pin (10) for operation by pressure applied to said switch by the foot of the person receiving the massage.

20. Massage appliance according to claim 13, characterized in that the massage pin (10) bears an interchangeable pin cap (31).

21. Massage appliance according to claim 20, characterized in that said pin cap (31) has nubs.

22. Massage appliance according to claim 13, characterized in that the massage pin (10) is detachably connected to said vibratory body.

23. Massage appliance according to claim 22, characterized in that the massage pin (10) is insertable in a recess in the vibratory body (24).

24. Massage appliance according to claim 13, characterized in that said second end portion of the guide lever (26) is secured to an axially slidable rod (27).

25. Massage appliance according to claim 24 wherein said rod is positioned beneath said vibratory body.

26. Massage appliance according to claim 13, characterized in that said second end portion of the guide lever (26) includes a friction bearing in which a stationary guide rod is guided.

27. Massage appliance according to claim 26 wherein said rod is positioned beneath said vibratory body.

28. Massage appliance according to claim 13, characterized in that said drive means includes a crank (25)

engaging said vibratory body (24) by which said massage pin is carried to move said vibratory body in said closed path upon rotation of said crank, and further includes rotary means for rotating said crank.

29. Massage appliance according to claim 28, characterized in that said rotary means includes an electric motor (19) and a reduction gear (21, 23) operatively interposed between said motor and said crank to rotate said crank.

30. Massage appliance according to claim 29, characterized in that the speed of rotation of the electric motor (19) is infinitely variable and capable of modulation.

* * * * *